United States Patent [19]

Leonard

[11] Patent Number: 4,716,912

[45] Date of Patent: Jan. 5, 1988

[54] FILTER CIGARETTE HAVING ADJUSTABLE AIR DILUTION

[75] Inventor: Gerard E. Leonard, Kernersville, N.C.

[73] Assignee: R. J. Reynolds Tobacco Company, Winston-Salem, N.C.

[21] Appl. No.: 829,341

[22] Filed: Feb. 14, 1986

[51] Int. Cl.[4] ..... A24D 3/04

[52] U.S. Cl. ..... 131/336; 131/198.2; 131/361; 131/362

[58] Field of Search ..... 131/336, 361, 198.1, 131/362, 198.2

[56] References Cited

U.S. PATENT DOCUMENTS

| | | | |
|---|---|---|---|
| 2,923,647 | 2/1960 | Aghnides . | |
| 3,496,945 | 2/1970 | Tomkin . | |
| 3,503,406 | 3/1970 | Riegel et al. . | |
| 4,433,696 | 2/1984 | Adams | 131/336 |
| 4,526,183 | 7/1985 | Nichols et al. . | |
| 4,527,573 | 7/1985 | Hausermann . | |
| 4,532,943 | 8/1985 | Nichols et al. . | |
| 4,570,649 | 2/1986 | Nichols et al. . | |
| 4,576,187 | 3/1986 | Deal . | |
| 4,601,298 | 7/1986 | Nichols et al. . | |

FOREIGN PATENT DOCUMENTS

| | | |
|---|---|---|
| 107507 | 5/1984 | European Pat. Off. . |

*Primary Examiner*—V. Millin

[57] ABSTRACT

A smoking article in the form of a filter cigarette can have adjustable air dilution capabilities. The filter element is movable toward and away from the tobacco rod along the longitudinal axis of the cigarette. Perforations in the tipping material of the cigarette expose the inner region of the cigarette and provide air dilution capabilities when the filter element and tobacco rod are in a spaced apart relationship. When the filter element and the tobacco rod are in a substantially abutting relationship, the perforations in the tipping material overlie a substantially air impermeable region of the tobacco rod thereby providing a low or non air diluted cigarette.

3 Claims, 4 Drawing Figures

FILTER CIGARETTE HAVING ADJUSTABLE AIR DILUTION

BACKGROUND OF THE INVENTION

This invention relates to smoking articles such as filter cigarettes, and in particular to such smoking articles having means for adjustable air dilution.

Cigarettes having adjustable regions have become subjects of increasing interest, particularly in situations wherein the adjustment of the air dilution value of filter cigarettes is desired. Known methods for providing adjustments to the air dilution value of filter cigarettes generally involve making one or more openings through a substantially air impermeable filter plug wrap, through the substantially air impermeable tipping paper and through a corresponding sleeve which is placed over the tipping paper, which sleeve is movable either rotatably or axially in order to select the degree to which the sets of openings are in registry.

Numerous known methods for providing adjustments to the air dilution value of filter cigarettes suffer from various problems. For example, a movable sleeve may be easily inadvertently removed from the cigarette by the smoker and not readily replaced. Furthermore, the degree of registry between the sets of openings can be inadvertently destroyed by slight axial movement of the sleeve. Accordingly, the air dilution value, once set by the smoker, is not insured to any degree of consistency.

Recently, as disclosed in U.S. Pat. No. 4,532,943, a filter cigarette comprises a filter plug having a mouthend segment and a tobacco rod end segment, wherein the two segments are axially connected for rotation about the longitudinal axis of the cigarette. Typically, in such a filter, the two segments are defined by a circumferential cut in the filter plug. However, a cigarette having a means for adjustment which does not require a segmented filter for rotation is clearly desirable.

It would be highly desirable to provide a filter cigarette having a longitudinally adjustable filter region, said filter region being easily settable and capable of having unlimited rotational ability. In addition, it would be highly desirable to provide a filter cigarette having an adjustable filter region, which cigarette is relatively easy to manufacture at a commercial scale.

SUMMARY OF INVENTION

This invention is a filter cigarette comprising in combination a rod of smokable material, an axially aligned filter plug at one end of the rod in an end-to-end relationship therewith, and tipping material circumscribing and being fixedly attached to the filter plug and circumscribing a portion of the rod in the region adjacent the filter plug. The cigarette further comprises first and second bands in an end-to-end relationship. The bands circumscribe the rod in the region adjacent the filter plug, and are disposed in and substantially fill the transverse region between the outer surface of the rod and the inner surface of the tipping material. The first band is fixedly attached to the rod in the region adjacent the filter plug. The second band is positioned adjacent the first band towards the fire end (i.e., the end which is lit) of the cigarette and the outer surface thereof is fixedly attached to the inner surface of the tipping material which overlies that second band. The tipping material comprises an air permeable region in the region therein which overlies an air impermeable region of the first band when the filter plug is positioned so as to substantially abut the rod. When the filter plug is positioned so as to substantially abut the rod, the first and second bands are positioned in a spaced apart relationship along the rod. As the filter plug is moved away from the rod along the longitudinal axis of the cigarette such that the filter plug does not substantially abut the rod, the air permeable region of the tipping material exposes the air space formed between the filter plug and the rod thereby providing air dilution capabilities to the cigarette.

The present invention provides an efficient and effective means for manufacturing filter cigarettes having adjustable air delivery capabilities. In particular, filter cigarettes having adjustable air delivery capabilities can be manufactured in a low air dilution/high delivery setting while employing essentially conventional cigarette manufacturing equipment.

The user of this invention can easily adjust the filter end of the cigarette along the longitudinal axis of the cigarette and relative to the rod.

DETAILED DESCRIPTION OF THE EMBODIMENTS

Figure 1:
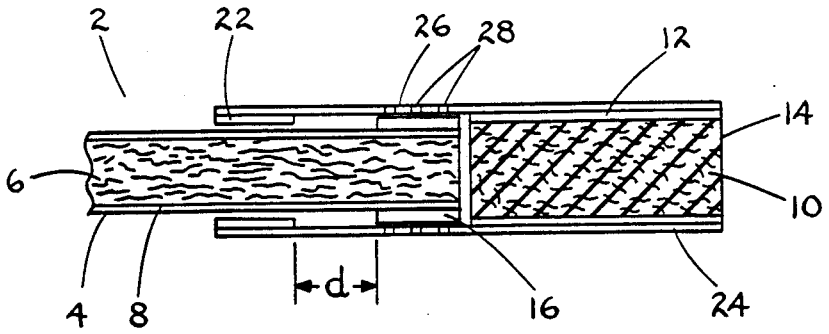
FIG. 1 is a diagrammatic cross sectional illustration of a portion of a cigarette showing the filter portion thereof, wherein the cigarette is positioned in the low or non-air dilution setting according to an embodiment of this invention.
Figure 2:
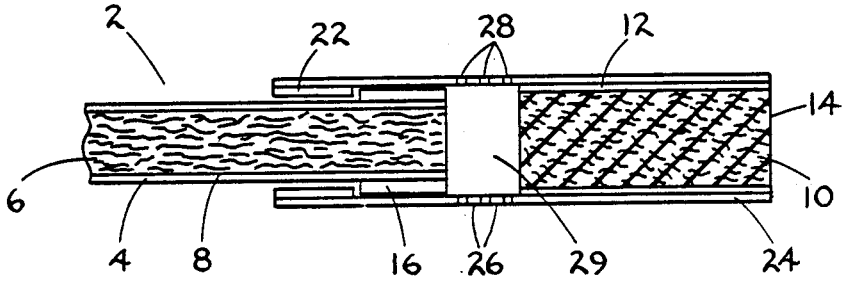
FIG. 2 is a diagrammatic cross sectional illustration of a portion of a cigarette showing the filter portion thereof, wherein the cigarette is positioned in the high air dilution setting according to an embodiment of this invention.

An embodiment of this invention shown in FIGS. 1 and 2 is a smoking article 2 in the form of a filter cigarette. The smoking article comprises a generally cylindrical rod 4 of smokable material 6 contained in wrapping material 8. Typically, the smokable material is a charge of shredded or cut tobacco, reconstituted tobacco, tobacco substitute, or blends thereof; and the wrapping material is a conventional substantially air impermeable cigarette wrapping paper. Rod 4 is axially aligned in an end-to-end relation with generally cylindrical filter plug 10. The filter plug can be constructed from any conventional filter material such as air permeable cellulose acetate; and the ends of the filter plug along the longitudinal axis of the cigarette are open to permit the passage of air and smoke. Filter plug 10 is preferably overwrapped with circumscribing plug wrap 12 in order to form wrapped plug 14. Typically, plug wrap 12 is a conventional, substantially air impermeable plug wrap material such as paper the inner surface of which is adhesively secured to the outer surface of the filter plug.

First band 16 circumscribes rod 4 at the end thereof adjacent the filter plug and the inner surface of the first band is fixedly attached to the outer surface of the rod using an adhesive material. First band 16 most preferably is provided from a substantially air impermeable material and is typically provided from air impermeable paper such as air impermeable tipping paper. The length which first band 16 extends longitudinally along rod 4 depends upon factors such as the air dilution capabilities required, the longitudinal extension of the filter region in the high air dilution setting, the amount of retention capabilities required in order to maintain connection of the rod to the filter plug, and the like. Typically, first band 16 can extend about 4 mm to about 6 mm longitudinally along the rod. In the preferred embodiment, the diameter of wrapped filter plug 14 (defined by filter plug 10 and circumscribing plug wrap 12) essentially equals that diameter of rod 4 circumscribed by said first band 16.

Second band 22 circumscribes rod 4 adjacent to first band 16 and towards the fire end of rod 4 relative to the first band. In the preferred embodiment, second band 22 is not fixedly attached to rod 4 and can be circumferentially rotatable about the longitudinal axis of rod 4. Second band 22 can be provided from a variety of materials and is typically provided from paper such as tipping paper, or the like. The length which the second band extends longitudinally along rod 4 can vary, and is typically great enough to provide sufficient retention of the rod to the filter plug. Typically, second band 22 can extend about 3 mm to about 6 mm longitudinally along the rod.

Tipping material 24 circumscribes (i.e., envelopes) the wrapped plug, the first band and the second band. The inner surface of tipping material 24 is fixedly adhered to the outer surface of wrapped plug 14 and to the outer surface of second band 22. Tipping material 24 can be an air permeable material or a substantially air impermeable material having air permeability region 26 therein (described further hereinafter). Preferably tipping material 24 is tipping paper. Tipping material 24 extends longitudinally along the smoking article in an amount which can vary. Typically, tipping material 24 extends along the wrapped plug from the extreme mouthend portion of the smoking article and along adjacent region of rod 4. The length which tipping material 24 extends along the rod depends upon factors such as the length of first band 16, second band 22 and the desired longitudinal extending distance between each of the aforementioned bands when the cigarette is positioned in the high air dilution setting.

Tipping material 24 which is substantially air impermeable in nature contains an air permeability region 26 (hereinafter referred to as region 26). Region 26 can extend circumferentially about the periphery of tipping material 24 in an amount which can vary. Region 26 can extend completely circumferentially about the longitudinal axis of the smoking article. Region 26 can extend longitudinally along tipping material 24 in an amount which is essentially dependent upon the spaced apart distance "d" extending along rod 4 between the first band and the second band. For example, in order that a cigarette exhibiting high air dilution can be achieved, it is desirable that the filter element and the rod be positioned such that region 26 not overlie a substantially air impermeable region formed by first band 16. Air permeable region 26 can be provided by a variety of means. For example, substantially air impermeable tipping paper can be cut or perforated in order to provide slits or holes, preferably which extend circumferentially about a portion of the cigarette. As illustrated in FIGS. 1 and 2, tipping material 24 can contain a series of holes 28 at region 26.

The amount of air dilution provided is a matter of choice. As used herein, "air dilution" refers to the ratio of the volume of air drawn through air dilution openings to the volume of air and smoke drawn through the cigarette and exiting the extreme mouthend portion of the cigarette.

Wrapped plug 14 is movable relative to rod 4 along the longitudinal axis of the cigarette relative to rod 4. The wrapped plug is retained to the rod as first band 16 and second band 22 provide a means for retaining the wrapped filter plug 14 to rod 4. In particular, the abutment of second band 22 against first band 16 when the cigarette is in the high air dilution setting provides an effective means for preventing the wrapped plug 14 from being pulled away from and out of contact from the rod. Frictional contact between the tipping material and the first band, as well as between the second band and the wrapping material of the rod, can allow the cigarette to be held at the desired setting during conditions of normal use.

FIG. 1 illustrates a cigarette positioned in a low or non air dilution setting whereby region 26 is prevented from providing effective air dilution due to the positioning of the region of air permeability of tipping material 24 with respect to first band 16 which is attached to rod 4. In particular, air permeable region 26 of the tipping material overlies the first band. An effective barrier to air dilution of the cigarette is thereby provided (i.e., the air impermeable region of the first band and the underlying wrapping material is in radial alignment with the substantially air permeable region of the tipping material). The combination of tipping material and each of underlying second band 22 and underlying plug wrap 12 provide essentially no air dilution characteristics to the cigarette.

FIG. 2 illustrates a cigarette positioned in a high air dilution setting. Wrapped plug 14 is moved longitudinally relative to rod 4 such that the region of air permeability of the tipping material can provide effective air dilution due to the fact that air permeable region 26 of the tipping material overlies air space 29 and not the substantially air impermeable region provided by first band 16 and underlying wrapping material 8. The amount of air dilution can be varied by varying the amount by which region 26 of tipping material 24 overlies the airspace 29 provided between the rod and the wrapped plug or other such factors.

Figure 3:
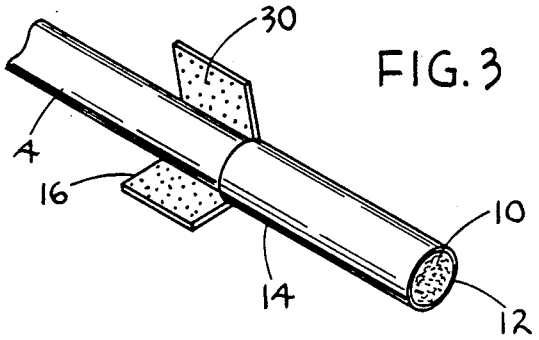
FIG. 3 is a partially fragmentary perspective taken from the mouthend of a partially assembled embodiment of this invention.
Figure 4:
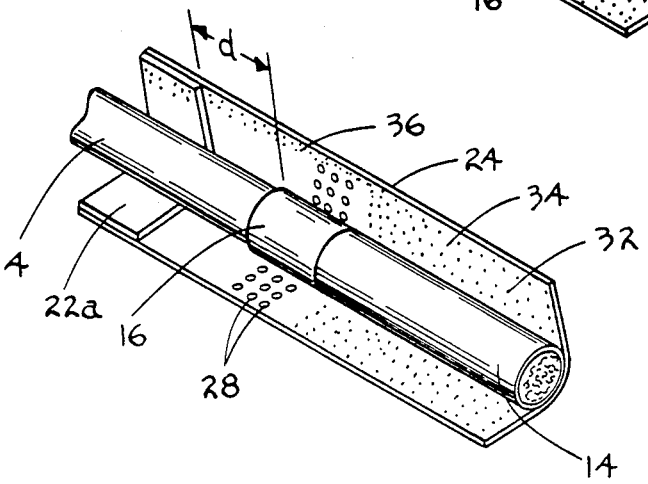
FIG. 4 is a partially fragmentary perspective taken from the mouthend of a partially assembled embodiment of this invention.

A process for providing the filter cigarettes of this invention is diagrammatically illustrated in FIGS. 3 and 4. In FIG. 3, rod 4 is circumscribed by first band 16 which is attached to rod 4 using adhesive material 30 which is applied to the inner surface of the first band. The rod also is axially aligned with wrapped plug 14 (defined by filter plug 10 and plug wrap material 12). In FIG. 4, a portion of the assembly illustrated in FIG. 3 is circumscribed by tipping material 24 which overlies wrapped plug 14, first band 16, and rod 4 along the spaced apart distance "d" which extends between the first band and the second band. Preferably, the second band is provided by attaching (i.e., with an adhesive material) a strip of wrap material **22*a* to the inner surface of the rod end region of tipping material 24. Adhesive material 32 is applied to region 34 of tipping material 24, which overlies wrapped plug 14. Adhesive 36 is applied to the outer lap zone along the inner longitudinal edge of tipping material 24 such that the tipping material can be folded over in order to effectively circumscribe the desired portion of the cigarette assembly as the lap bonding maintains the tipping material in the form of a tube. Thus, the first and second bands are disposed (i.e., located) in and substantially fill the transverse region between the outer surface of the rod and the inner surface of the tipping material. The air dilution region can be provided by a plurality of holes 28** which can be provided by perforating the tipping material.

If desired, markings (e.g., with ink) can be printed on the tipping material and the exposed portion of the wrapping material of the rod in order to provide a visual indication of the amount of air dilution which is selected.

It is understood that the particular embodiments described above are only illustrative of the principles of this invention, and that various modifications can be made by those skilled in the art without departing from the scope and spirit of the invention.

What is claimed is:

1. A filter cigarette comprising in combination a rod of smokable material, an axially aligned filter plug adjacent one end of the rod, and tipping material circumscribing and being fixedly attached to the filter plug and circumscribing a portion of the rod in the region adjacent the filter plug; said cigarette further comprising first and second bands in an end-to-end relationship, said bands circumscribing the rod in the region adjacent the filter plug and being disposed in and substantially filling the transverse region between the outer surface of the rod and the inner surface of the tipping material;

the first band being fixedly attached to the rod in the region adjacent the filter plug;

the second band being positioned adjacent the first band towards the fire end of the cigarette and the outer surface thereof is fixedly attached to the inner surface of the tipping material which overlies said band;

the tipping material comprising an air permeable region in the region therein which overlies and air impermeable region of the first band when the filter plug is positioned as to substantially abut the rod;

wherein the first and second bands are positioned in a spaced apart relationship when the filter plug is positioned so as to substantially abut the rod;

wherein movement of the filter plug away from the rod along the longitudinal axis of the cigarette in order that the filter plug does not abut the rod provides exposure of the airspace formed between the filter plug and the rod through the air permeable region of the tipping material and thereby providing air dilution capabilities to the cigarette.

2. The filter cigarette of claim 1 wherein the material of each of said first band, said second band and said tipping material are paper, and the regions of air permeability in the tipping paper is provided by a series of perforations therein.

3. The filter cigarette of claim 2 wherein said rod of smokable material comprises a smokable material contained in a wrapping material, wherein said wrapping material is substantially air impermeable paper.

* * * * *